US007644901B2

(12) United States Patent
Scheper et al.

(10) Patent No.: US 7,644,901 B2
(45) Date of Patent: Jan. 12, 2010

(54) DIVE TANK SUPPORT DEVICE

(75) Inventors: Jack Scheper, Boca Raton, FL (US); Michael Scheper, Boca Raton, FL (US)

(73) Assignee: Scuba Mate, Inc., Boca Raton, FL (US)

( * ) Notice: Subject to any disclaimer, the term of this patent is extended or adjusted under 35 U.S.C. 154(b) by 0 days.

(21) Appl. No.: 12/012,520

(22) Filed: Feb. 1, 2008

(65) Prior Publication Data

US 2008/0210836 A1 Sep. 4, 2008

Related U.S. Application Data

(63) Continuation of application No. 11/210,979, filed on Aug. 24, 2005, now abandoned.

(51) Int. Cl.
*A47K 1/08* (2006.01)

(52) U.S. Cl. ..... 248/311.2; 248/371; 114/364

(58) Field of Classification Search ..... 248/311.2, 248/371, 558; 114/364; 220/478
See application file for complete search history.

(56) References Cited

U.S. PATENT DOCUMENTS

| | | | |
|---|---|---|---|
| 730,690 | A | 6/1903 | Palmer |
| 1,081,339 | A | 12/1913 | Smith |
| 2,234,360 | A | 3/1941 | Whitson |
| 2,406,334 | A | 8/1946 | Keller et al. |
| 2,719,571 | A | 10/1955 | Taylor |
| 2,952,432 | A | 9/1960 | Valdez |
| 2,968,159 | A | 1/1961 | Edmund |
| 3,008,679 | A | 11/1961 | Powell |
| D200,474 | S | 3/1965 | Boldosser |
| 3,327,656 | A | 6/1967 | Schwartz |
| 3,547,391 | A | 12/1970 | Johnson |
| 3,791,403 | A | 2/1974 | Folkerth |
| 4,015,810 | A | 4/1977 | Williams |
| 4,023,761 | A | 5/1977 | Molis |
| 4,062,299 | A | 12/1977 | Smith |
| 4,093,171 | A | 6/1978 | Mengo |
| 4,213,592 | A | 7/1980 | Lingenfelser |
| 4,485,579 | A | 12/1984 | Hawie |
| 4,749,162 | A | 6/1988 | Wanzor |
| 4,801,060 | A | 1/1989 | Thomson |
| 5,025,935 | A | 6/1991 | Hadachek |
| D319,003 | S | 8/1991 | Scharrenberg, Jr. |
| 5,074,714 | A | 12/1991 | Franco |
| 5,094,415 | A | 3/1992 | Revette et al. |
| 5,299,721 | A | 4/1994 | Cummings |
| D389,896 | S | 1/1998 | Salvucci, Sr. |
| D392,081 | S | 3/1998 | Salvucci, Sr. |

(Continued)

*Primary Examiner*—J. Allen Shriver, II
*Assistant Examiner*—Bradley H Duckworth
(74) *Attorney, Agent, or Firm*—Novak Druce + Quigg LLP; Joseph W. Bain

(57) ABSTRACT

A dive tank support device for supporting a dive tank while a diver is attempting to attach the dive tank to the diver's body immediately before jumping from a vessel and beginning a dive. The dive tank support device may be formed from a body having a bottom support adapted to support a dive tank and at least one sidewall extending up from the bottom support and configured to limit tilting of the dive tank relative to the bottom support. The body supports the dive tank and the recess enables the dive tank to be easily pulled from the dive tank support device once a diver has attached the dive tank to himself.

10 Claims, 3 Drawing Sheets

U.S. PATENT DOCUMENTS

| | | | |
|---|---|---|---|
| 5,823,496 | A | 10/1998 | Foley et al. |
| 6,082,157 | A | 7/2000 | Boyce |
| 6,113,048 | A | 9/2000 | Shire |
| 6,220,557 | B1 | 4/2001 | Ziaylek et al. |
| 6,766,912 | B1 | 7/2004 | Gibbs |
| 6,883,766 | B1 | 4/2005 | Ziaylek et al. |
| 6,926,243 | B1 | 8/2005 | Ziaylek et al. |
| 7,004,102 | B2 | 2/2006 | Sampson et al. |
| 2004/0108429 | A1 | 6/2004 | Field et al. |
| 2006/0006302 | A1 | 1/2006 | Gragg |
| 2006/0016382 | A1 | 1/2006 | Sampson et al. |
| 2006/0054772 | A1 | 3/2006 | Priscott et al. |

DIVE TANK SUPPORT DEVICE

CROSS REFERENCE TO RELATED APPLICATIONS

This application is a continuation of U.S. patent application Ser. No. 11/210,979, filed Aug. 24, 2005, now abandoned.

FIELD OF THE INVENTION

This invention is directed generally to underwater diving, and more specifically to devices for supporting dive tanks on a vessel.

BACKGROUND OF THE INVENTION

Conventional underwater breathing apparatuses typically include a dive tank filled with compressed air or other appropriate gases. Many conventional dive tanks are large, heavy and greatly restrict a diver's mobility when not in the water. For instance, some conventional dive tanks are cylindrical with a diameter of about one foot and a height of about two and a half feet. Many conventional dive tanks are formed from steel or aluminum; which results in a tank that weighs between about thirty pounds and forty pounds.

Most conventional underwater diving systems include a system for mounting a dive tank to a diver so that the dive tank rests on the back of the diver. The dive tank is usually mounted so that the control valve is positioned in close proximity to the diver's head and centered between the diver's shoulders. The dive tank is typically held in place with a vest that fits around the chest of the diver. The vest often includes bladders and is used as a buoyancy control device (BCD) when the diver is underwater. Because of the position of the control valve on the tank, the tank is not positioned high on the diver's back. Rather, the dive tank is positioned low on the diver's back. This position often makes it difficult for a diver to move around a vessel.

Immediately before a dive, a diver suits up with all of the necessary equipment, including a mask, snorkel, fins, BCD, tank, gauges, and wetsuit, if necessary. While all of these items assist a diver when the diver is underwater, these items are very cumbersome when the diver is not in the water. Most cumbersome is often the combination of the heavy tank on the diver's back and the fins. Successfully attaching a dive tank to a diver is best accomplished with the assistance of another person. The other person stabilizes the tank while the diver inserts the diver's arms through the arm holes in the BCD.

While assistance is easy to find on commercial dive boats and on boats with a large crew, such assistance is not available when diving alone or when diving from a boat with fewer occupants. In such situations, a diver is often faced with the task of attaching a dive tank to the diver with little or inadequate assistance. Such a procedure often includes positioning the tank on the deck or on another stable surface. However, a vessel is often being tossed about by the seas and keeping a tank with a BCD attached in an upright position can be difficult. Without assistance, attaching a dive tank to a diver is a difficult procedure. Thus, a need exists for a device that supports a dive tank while a diver attaches the tank to the diver.

SUMMARY OF THE INVENTION

This invention is directed to a dive tank support device configured to support a dive tank while a diver attaches the tank to the diver. The dive tank support device may enable a diver to attach a dive tank to the diver without other assistance. In at least one embodiment, the dive tank support device is designed to be releasably attached to a gunnel of a vessel so that a diver may place a dive tank in the dive tank support device without the tank falling from the device. The diver may then attach the tank to the diver and stand up with the tank attached to the diver's back. The motion of standing up or moving away from the dive tank support device removes the tank from the dive tank support device.

The dive tank support device may be formed from a body having a bottom support adapted to support a dive tank and at least one sidewall extending up from the bottom support and configured to limit tilting of the dive tank relative to the bottom support. The body may be generally cylindrical with a diameter larger than the dive tank to be received within the body. The body may also include at least one dive tank removal recess in the sidewall of the body configured to enable the dive tank to be removed from the support device through the sidewall of the body. The dive tank removal recess in the body may extend from an upper edge of the body to a position in close proximity with the bottom support. The dive tank removal recess may have a width that is larger than a dive tank configured to be received within the body.

A support system may be coupled to the body of the dive tank support device for supporting a dive tank in the body of the dive tank support device while on a vessel. The support system may be coupled to the body of the dive tank support device for supporting the dive tank in the body and in close proximity to a covering board of a gunnel. In at least one embodiment, the support system may be formed from at least one shaft extending from the body and may be configured to be received within a rod holder attached to a vessel. The support system may include an alignment system configured to adjust the body relative to the support system. The support system may include at least one ball joint coupled to the body and to the shaft to enable rotation of the body about two axes relative to the shaft. The support system may also include at least one locking arm that may be used to secure the body in a position relative to the at least one shaft.

In another embodiment, the shaft may be positioned at an angle of between about ten degrees and about thirty five degrees relative to a longitudinal axis of the body. In one embodiment, the shaft may be positioned at an angle of about fifteen degrees or thirty degrees relative to the longitudinal axis of the body to conform with conventional rod holder configurations.

The dive tank support device may be used by a diver to assist the diver in attaching a dive tank to the diver. A diver may secure an attachment device, such as a BCD, to a dive tank. The dive tank support device may be attached to a vessel in a location near the gunnel of the vessel. In at least one embodiment, a shaft of the dive tank support device may be inserted into a rod holder in the gunnel of the vessel, thereby releasably attaching the dive tank support device to the vessel. The diver may position the dive tank in the dive tank support device by inserting the dive tank into the dive tank removal recess. The diver may then attach the dive tank to the diver by inserting the diver's arms through the arm holes in the BCD and securing the appropriate straps. Once the dive tank is attached to the diver, the diver may move away from the dive tank support device, such as by leaning forward, to remove the dive tank from the dive tank support device. As the diver moves from the dive tank support device, the tank is supported by the diver's shoulders and back. The diver may then move next to the gunnel and fall over the gunnel to begin a dive. The diver is not required to walk a distance to be able to enter the water and begin a dive.

An advantage of this invention is that the dive tank support device assists a diver in enabling the diver to attach a dive tank and BCD to the diver without assistance from another person.

Another advantage of this invention is that the dive tank support device enables a diver to attach a dive tank to the diver in close proximity to the location where the diver will enter the water, thereby reducing the distance the diver travels to enter the water and the awkwardness associated with such movement.

Yet another advantage of the dive tank support device is that the dive tank support device is removable and configured to fit within a conventional rod holder. Thus, a vessel having conventional rod holders does not need to be adapted. Rather, a dive tank support device may be attached to the vessel quickly by simply inserting a shaft of the dive tank support device into the rod holder. A removable dive tank support device is very desirable for vessels that are not used as dive boats all of the time. The dive tank support device can be quickly installed in a rod holder when needed and can be removed as easily.

These and other embodiments will be described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF PREFERRED EMBODIMENTS

Figure 1:
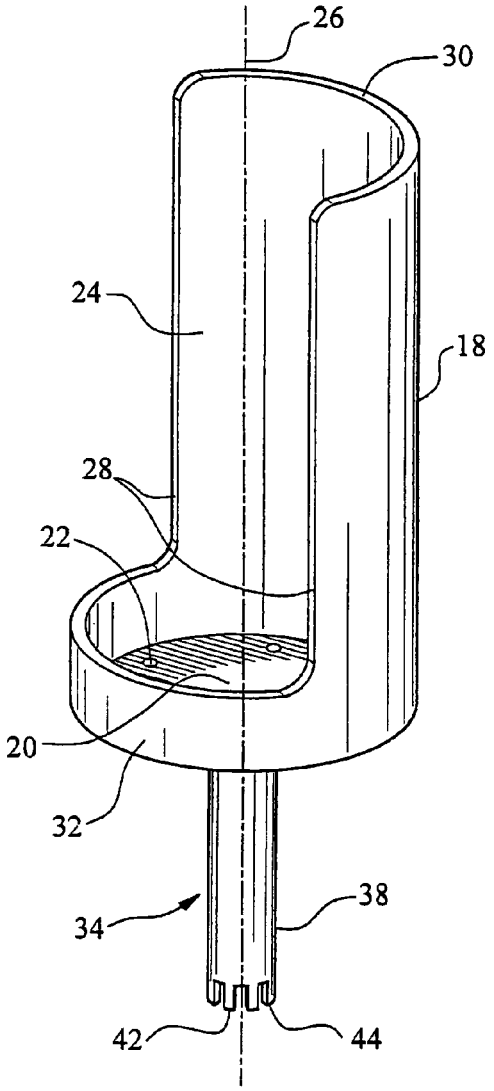
FIG. 1 is a perspective view of a dive tank support device according to an embodiment of the invention.
Figure 2:
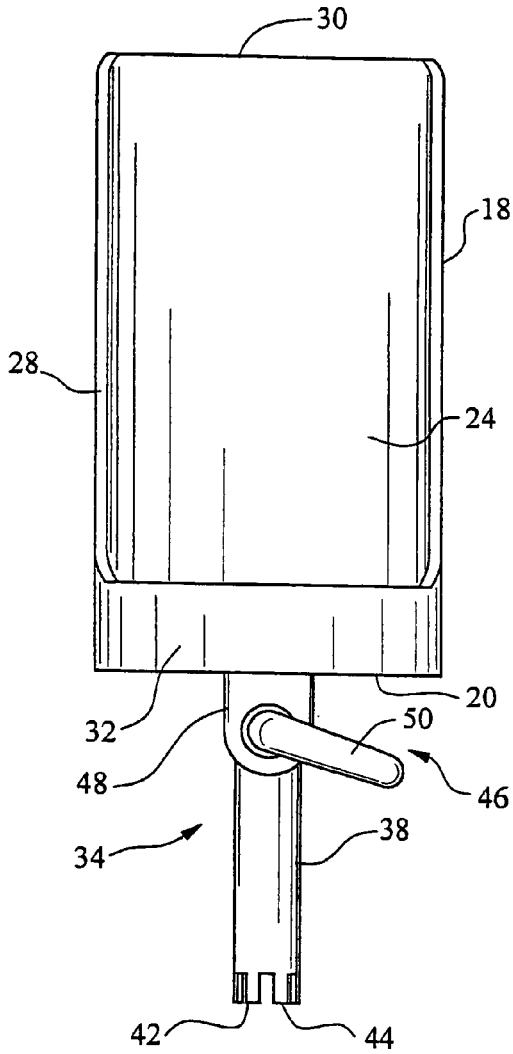
FIG. 2 is a front view of the dive tank support device shown in FIG. 1.
Figure 3:
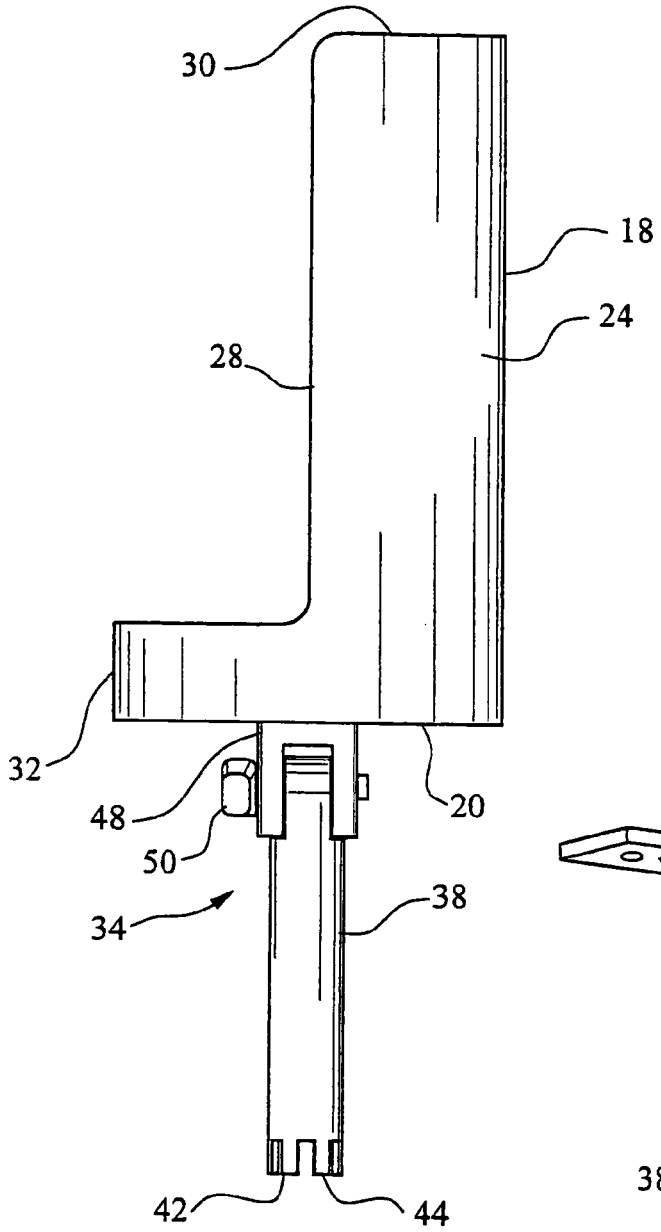
FIG. 3 is a right side view of the dive tank support device shown in FIG. 1.
Figure 4:
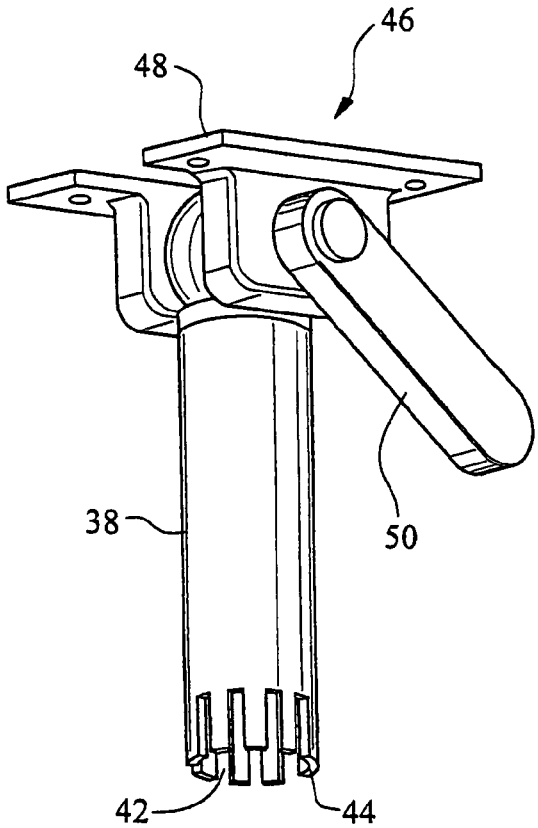
FIG. 4 is a perspective view of the support system of the dive tank support device.

As shown in FIGS. 1-5, this invention is directed to a dive tank support device 10 configured to support a dive tank 12 while a diver attaches the tank 12 to the diver. The dive tank support device 10 may support a dive tank 12 without other assistance and may enable the dive tank 12 to be pulled from the dive tank support device 10 by a diver to which the dive tank 12 is attached. In at least one embodiment, the dive tank support device 10 is designed to be releasably attached to a gunnel 14 of a vessel 16 so that a diver may place a dive tank 12 in the dive tank support device 10 without the tank 12 falling from the device 10. The diver may then attach the tank 10 to the diver and stand up with the tank 12 attached to the diver's back. The motion of a diver standing up or moving away from the dive tank support device 10 may remove the tank 12 from the dive tank support device 10.

The dive tank support device 10 may be formed from a body 18 having a bottom support 20 adapted to support a dive tank 12. The bottom support 20 may be formed form any configuration capable of supporting a dive tank 12. As shown in FIG. 1, the bottom support 20 may be a solid surface. The bottom support 20 may include drainage holes 22 for removing water from the device 10. The body 18 of the device 10 may include one or more sidewalls 24 for retaining a dive tank 12. The sidewalls 24 may extend up from the bottom support 20 and may be configured to limit tilting of the dive tank 12 out of alignment with a longitudinal axis 26.

The body 18 may have any appropriate size and shape for containing the dive tank 12. It is well understood that dive tanks 12 are made in numerous heights and diameters. Thus, the dive tank support device 10 may have numerous embodiments configured to receive different sized tanks 12. In at least one embodiment, as shown in FIG. 1, the body 18 may be generally cylindrical. The body 18 may have a diameter larger than a dive tank 12 configured to be received within the body 18. The body 18 may be formed from materials appropriate to handle the load of a dive tank 12 and the corrosive effects of saltwater. In at least one embodiment, the body 18 may be formed from a marine grade polymer material.

The body 18 may also include at least one dive tank removal recess 28 in the sidewall 24 of the body 18. The dive tank removal recess 28 may be configured to enable a dive tank 12 to be removed from the dive tank support device 10 through the sidewall 24 of the body 18. The dive tank removal recess 28 in the body 18 may extend from an upper edge 30 of the body 18 to a position in close proximity with the bottom support 20, as shown in FIG. 1. A dive tank retaining wall 32 of the body 18 may remain under the dive tank removal recess 28 to retain a dive tank 12 in the body 18. The dive tank removal recess 28 may have a width that is larger than a dive tank 12 that is capable of being configured to be received within the body. In at least one embodiment, as shown in FIG. 1, the dive tank removal recess 28 may extend approximately 180 degrees of a cylindrical sidewall 24. In another embodiment, the dive tank removal recess 28 may extend around an arcuate path greater than 180 degrees. If the dive tank removal recess 28 is smaller than 180 degrees, the sidewall 24 should be formed from a flexible material to enable the sidewalls to flex to enable a dive tank 12 to be pulled through the dive tank removal recess 28.

The dive tank support device 10 may also include a support system 34 that may be coupled to the body 18 for supporting a dive tank 12 in the body 18 on a vessel 16. In at least one embodiment, the support system 34 may be coupled to the body 18 for supporting a dive tank 12 in close proximity to a covering board 36 of a gunnel 14. The support system 34 may be formed from at least one shaft 38 extending from the body 18. In at least one embodiment, the shaft 38 may be configured to be received within a rod holder 40 attached to a vessel 16. The shaft 38 may include a plurality of slots 42 in a lower edge 44 of the shaft 38 enabling the shaft 38 to engage a cross-support (not shown) in the rod holder 40 to increase stability of the shaft 38 in the rod holder 40. The shaft 38 may be formed from materials appropriate to handle the load of a dive tank 12 and the corrosive effects of saltwater. In at least one embodiment, the shaft 38 may be formed from a stainless steel or other appropriate material.

The support system 34 may also include an adjustment system 46 configured to move the body 18 relative to the shaft 38. The adjustment system 46 enables the bottom support 20 to be positioned relatively horizontal regardless of the angle at which the shaft 38 is attached to a vessel 16. The adjustment system 46 may also enable the bottom surface 20 to be slightly tilted away from the side of the dive tank removal recess 28 to create a force pushing a dive tank 12 away from the dive tank removal recess 28. In at least one embodiment, the adjustment system 46 may be formed from at least one ball joint 48 positioned between the shaft 38 and the body 18. The ball joint 48 may enable rotation of the body 18 relative to the shaft 38 about two axes. The position of the body 18 relative to the shaft 38 may be held in position using a locking arm 50. The locking arm 50 may be rotated in a first direction to release the body 18 to rotate and tilt relative to the shaft 38 and the locking arm 50 may be rotated in a second direction to affix the body 18 in a position relative to the shaft 38.

Figure 5:
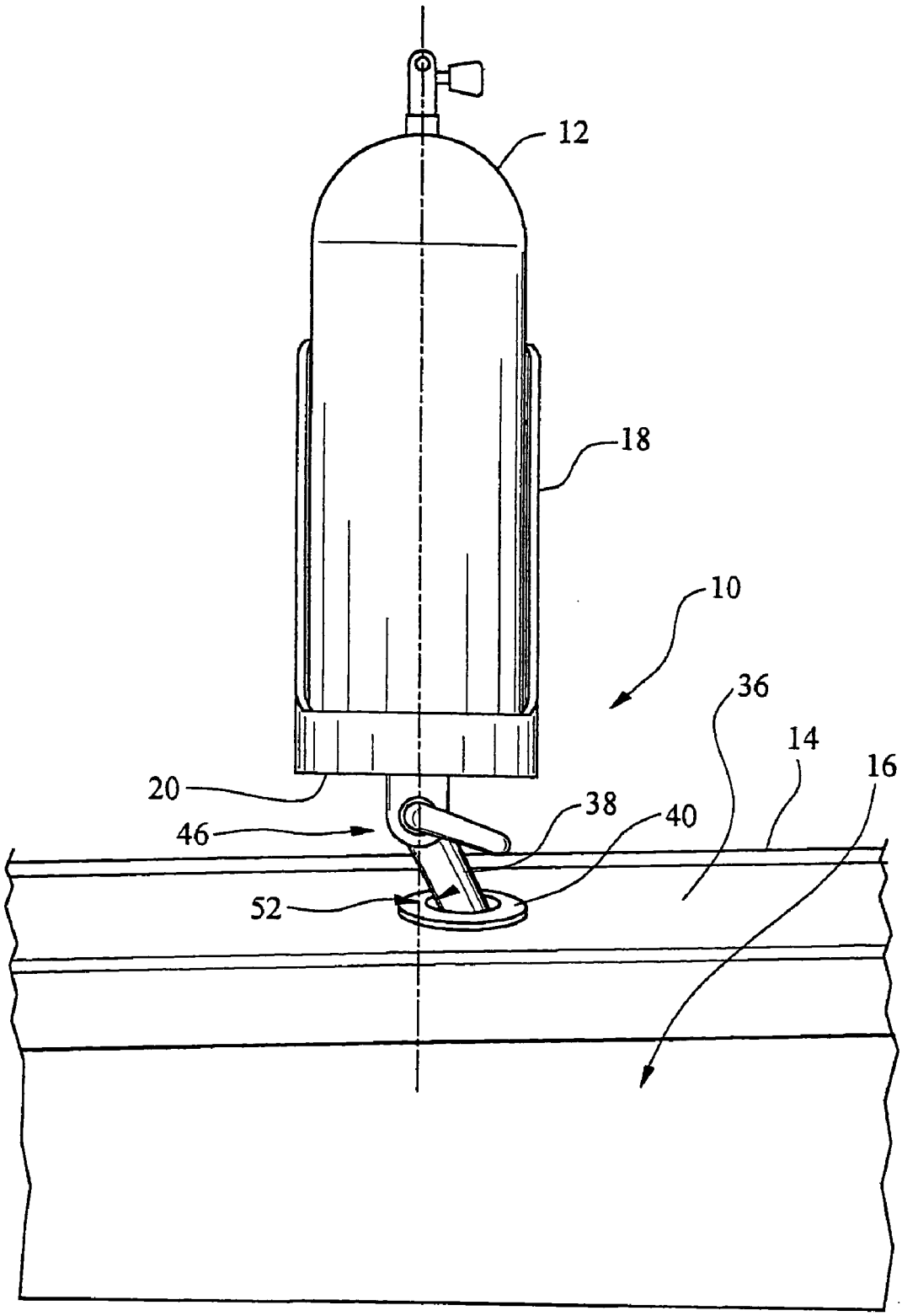
FIG. 5 is a perspective view of the dive tank support device attached to a rod holder on a vessel.

The support system 18, as shown in FIG. 5, may position the body 18 at an angle 52 of between about ten degrees and about thirty five degrees relative to the longitudinal axis 26 of the body 18. In one embodiment, the shaft 38 may be positioned at an angle 52 of about fifteen degrees or thirty degrees relative to the longitudinal axis 26 of the body 18 to conform with conventional rod holder 40 configurations.

The dive tank support device 10 may be used by a diver to assist the diver in attaching a dive tank 12 to the diver. A diver may first secure an attachment device, such as a BCD (not shown), to a dive tank 12 if not already done so. The dive tank support device 10 may be attached to a vessel 16, such as near the gunnel 14 of the vessel 16. In at least one embodiment, a shaft 38 of the dive tank support device 10 may be inserted into a rod holder 40 in the gunnel 14 of the vessel 16. The diver may position the dive tank 12 in the dive tank support device 10 by inserting the dive tank through the dive tank removal recess. The diver may then attach the dive tank 12 to the diver by inserting the diver's arms through the arm holes in the BCD and securing the appropriate straps. Once the dive tank 12 is attached to the diver, the diver may move away from the dive tank support device 10 to remove the dive tank 12 from the dive tank support device. The diver may take a step in the direction the diver is facing so that the dive tank 12 is pulled from the body 18. As the diver moves from the dive tank support device 10, the dive tank 12 is supported by the diver's shoulders and back. The diver may then move next to the gunnel 14 and fall over the gunnel 14 into the water to begin a dive.

It should be understood that the examples and embodiments described herein are for illustrative purposes only and that various modifications or changes in light thereof will be obvious to persons skilled in the art, and that such modifications or changes are to be included within the spirit and purview of this application. Moreover, the invention can take other specific forms without departing from the spirit or essential attributes thereof.

We claim:

1. A dive tank support device for facilitating the loading of a dive tank on a user from a boat gunnel, comprising:

a dive tank support body having a bottom support for supporting a bottom of a dive tank, said bottom support defining a bottom support periphery, said dive tank support body having a sidewall extending axially beginning from the bottom support periphery to an upper edge of the sidewall, said sidewall having a sidewall periphery extending the same extent as the bottom support periphery;

wherein the dive tank support body has an open top defined by the upper edge of the sidewall, whereby an upper portion of a dive tank when positioned in the dive tank support device can extend above the dive tank support body;

wherein the dive tank support body has a dive tank removal recess in the sidewall of the dive tank support body configured to enable a dive tank to be removed from the support device through the recess in the sidewall of the dive tank support body, said dive tank removal recess in the sidewall extending axially beginning from the upper edge down to a position in proximity to the bottom support, said sidewall thereby providing a retaining wall axially between the bottom support and the recess;

wherein the recess, along its entire axial extent, extends peripherally to half of the sidewall periphery; and a support system for securing the dive tank support body to a boat gunnel, said support system including a shaft extending from the dive tank support body bottom support, wherein the shaft is adapted to be placed in a gunnel rod holder of a boat and is adjustable relative to the bottom support to be placed at an angle to the bottom support.

2. The dive tank support device of claim 1, wherein the support system further comprises an adjustment system enabling the dive tank support body to be rotated relative to the support.

3. The dive tank support device of claim 2, wherein the adjustment system comprises at least one ball joint adapted to enable rotation of the dive tank support body relative to the support system about two axes.

4. The dive tank support device of claim 3, wherein the adjustment system further comprises at least one locking arm for securing the dive tank support body in a position relative to the at least one shaft.

5. The dive tank support device of claim 1, wherein the shaft is positioned at an angle of between about ten degrees and about thirty five degrees relative to a longitudinal axis of the dive tank support body.

6. The dive tank support device of claim 5, wherein the shaft is positioned at an angle of about fifteen degrees relative to the longitudinal axis of the dive tank support body.

7. The dive tank support device of claim 5, wherein the shaft is positioned at an angle of about thirty degrees relative to the longitudinal axis of the dive tank support body.

8. The dive tank support device of claim 1, wherein the shaft is angled relative to a longitudinal axis of the dive tank support body so that the dive tank support body bottom support is titled away from the dive tank removal recess to create a force pushing a dive tank away from the dive tank removal recess when stored in the dive tank support device.

9. The dive tank support device of claim 1, further comprising a dive tank placed in the device.

10. The dive tank support device of claim 9, further comprising a gunnel with a rod holder, wherein the shaft is located in the rod holder to hold the dive tank support device above the gunnel and wherein the dive tank is leaning toward the sidewall in the support device and away from the recess.

* * * * *